US011422480B2

(12) United States Patent
Ishikawa et al.

(10) Patent No.: US 11,422,480 B2
(45) Date of Patent: Aug. 23, 2022

(54) FERRITE CARRIER CORE MATERIAL FOR ELECTROPHOTOGRAPHIC DEVELOPER, FERRITE CARRIER, MANUFACTURING METHOD THEREOF, AND ELECTROPHOTOGRAPHIC DEVELOPER USING SAID FERRITE

(71) Applicant: POWDERTECH CO., LTD., Kashiwa (JP)

(72) Inventors: Makoto Ishikawa, Kashiwa (JP); Hiroki Sawamoto, Kashiwa (JP); Tetsuya Uemura, Kashiwa (JP)

(73) Assignee: POWDERTECH CO., LTD., Kashiwa (JP)

( * ) Notice: Subject to any disclaimer, the term of this patent is extended or adjusted under 35 U.S.C. 154(b) by 0 days.

(21) Appl. No.: 16/492,894

(22) PCT Filed: Mar. 29, 2018

(86) PCT No.: PCT/JP2018/013512
§ 371 (c)(1),
(2) Date: Sep. 10, 2019

(87) PCT Pub. No.: WO2018/181845
PCT Pub. Date: Oct. 4, 2018

(65) Prior Publication Data

US 2020/0057399 A1 Feb. 20, 2020

(30) Foreign Application Priority Data

Mar. 29, 2017 (JP) ..... JP2017-064931

(51) Int. Cl.
*G03G 9/107* (2006.01)
*G03G 9/08* (2006.01)
*G03G 9/083* (2006.01)
*G03G 9/113* (2006.01)

(52) U.S. Cl.
CPC ..... *G03G 9/1075* (2013.01); *G03G 9/0819* (2013.01); *G03G 9/0823* (2013.01); *G03G 9/0833* (2013.01); *G03G 9/1085* (2020.08); *G03G 9/1133* (2013.01); *G03G 9/1136* (2013.01)

(58) Field of Classification Search
CPC ..... G03G 9/10; G03G 9/107; G03G 9/108; G03G 9/1085
See application file for complete search history.

(56) References Cited

U.S. PATENT DOCUMENTS

2005/0064315 A1 3/2005 Yamaguchi et al.
2007/0154833 A1 7/2007 Kayamoto et al.
2007/0231731 A1* 10/2007 Suwa ..... G03G 9/1075 430/111.33
2007/0243482 A1* 10/2007 Yamaguchi ..... G03G 9/1075 430/111.35
2011/0212399 A1* 9/2011 Suwa ..... G03G 9/10 430/111.32
2012/0076551 A1 3/2012 Kayamoto et al.
2013/0344431 A1 12/2013 Iida et al.
2014/0017609 A1* 1/2014 Kawauchi ..... G03G 9/107 430/111.34

FOREIGN PATENT DOCUMENTS

| | | | |
|---|---|---|---|
| EP | 1349014 | A2 | 10/2003 |
| EP | 1840661 | A1 | 10/2007 |
| EP | 2131248 | A1 | 12/2009 |
| EP | 2584410 | A1 | 4/2013 |
| JP | 2005250424 | A | 9/2005 |
| JP | 2005258247 | A | 9/2005 |
| JP | 2006235143 | A | 9/2006 |
| JP | 2007086456 | A | 4/2007 |
| JP | 2007271663 | A | 10/2007 |
| JP | 2008026582 | A | 2/2008 |
| JP | 2008191463 | A | 8/2008 |
| JP | 2009025676 | A | 2/2009 |
| JP | 2009237049 | A | 10/2009 |
| JP | 2012194307 | A | 10/2012 |
| JP | 2013137455 | A | 7/2013 |
| JP | 2015182905 | A | 10/2015 |
| JP | 2016118646 | A | 6/2016 |
| WO | 2005062132 | A2 | 7/2005 |

OTHER PUBLICATIONS

International Search Report and Written Opinion for related International Application No. PCT/JP2018/013512, dated Jun. 12, 2018; English translation of ISR provided; 20 pages.
EESR for related EP App. No. 18776707.4 dated Nov. 4, 2020; 9 pages.

* cited by examiner

*Primary Examiner* — Peter L Vajda
(74) *Attorney, Agent, or Firm* — Procopio, Cory, Hargreaves & Savitch LLP

(57) ABSTRACT

The present invention provides: a ferrite carrier core material for an electrophotographic developer, the material having a mesh passing amount of 3 wt % or less as indicated by the ratio of the weight of particles passing through a 16 μm-mesh to the weight of whole particles constituting a powder, and having a particle strength index of 2 wt % or less as indicated by a difference between the mesh passing amounts before and after crushing; a ferrite carrier which is for an electrophotographic developer and in which the surface of the ferrite carrier core material is coated with a resin; and an electrophotographic developer which includes the ferrite carrier and a toner.

16 Claims, No Drawings

FERRITE CARRIER CORE MATERIAL FOR ELECTROPHOTOGRAPHIC DEVELOPER, FERRITE CARRIER, MANUFACTURING METHOD THEREOF, AND ELECTROPHOTOGRAPHIC DEVELOPER USING SAID FERRITE

CROSS-REFERENCE TO RELATED APPLICATIONS

This application is a U.S. National Stage entry of PCT Application No: PCT/JP2018/013512 filed on Mar. 29, 2018, which claims priority to Japanese Patent Application No. 2017-064931, filed Mar. 29, 2017, the contents of which are incorporated herein by reference.

TECHNICAL FIELD

The present invention relates to a ferrite carrier core for an electrophotographic developer used in a two-component electrophotographic developer used in a copying machine, a printer and the like, a ferrite carrier, and a method for producing them, and an electrophotographic developer using the ferrite carrier.

BACKGROUND ART

The electrophotographic development method is a method in which toner particles in a developer are made to adhere to electrostatic latent images formed on a photoreceptor to develop the images. The developer used in this method is classified into a two-component developer composed of toner particles and carrier particles, and a one-component developer using only the toner particles.

As a development method using the two-component developer composed of toner particles and carrier particles among those developers, a cascade method and the like were formerly employed, but a magnetic brush method using a magnet roll is now in the mainstream.

In the two-component developer, a carrier particle is a carrier substance which is stirred with a toner particle in a development box filled with the developer to impart a desired charge to the toner particle, and further transports the charged toner particle to a surface of a photoreceptor to form toner images on the photoreceptor. The carrier particle remaining on a development roll holding a magnet is again returned from the development roll to the development box, mixed and stirred with a fresh toner particle, and used repeatedly in a certain period.

In the two-component developer, unlike a one-component developer, the carrier particle has functions of being mixed and stirred with a toner particle to charge the toner particle and transporting it to a surface of a photoreceptor, and it has good controllability on designing a developer. Therefore, the two-component developer is suitably used in a full-color development apparatus requiring a high image quality, a high-speed printing apparatus requiring reliability for maintaining image and durability, and the like.

In the two-component developer thus used, it is needed that imaging characteristics such as image density, fogging, white spots, gradation, and resolving power show predetermined values from the initial stage, and additionally these characteristics do not vary and are stably maintained during the durable printing period (i.e., a long period of time of use). In order to stably maintain these characteristics, the characteristics of the carrier particles contained in the two-component developer are required to be stable.

In recent years, as the diameter of toner particles is reduced for aiming higher image quality, reduction of the diameter of carrier particles is progressed. However, there is a problem that fine carrier particles are easy to damage the photoreceptor or the fixing roller due to carrier scattering. In order to solve the problem, various proposals have been made that define particle size distribution of the carrier particles.

For example, in Patent Literature 1, the particle size distribution in which a ratio of number distribution and volume distribution is in a predetermined range, and the average particle diameter of the carrier particles are specified, and the content of the fine particles having a particle size of less than 20 μm is specified as 0 to 7% by weight. In Patent Literature 1, the particle diameter of the carrier particles is measured by a device using a method (laser scattering method) for determining a particle diameter from a scattering pattern obtained by irradiating particles with a laser beam.

When the particles are irradiated with laser light, a scattering pattern is generated by light scattered from the particles. Since the measurement target is a particle group including a large number of particles instead of a single particle, and particles of various particle sizes are mixed in the particle group, the obtained scattering pattern is a superposition of scattered light of various particles. By analyzing the scattering pattern, the laser scattering method can determine what size of particles are included in what proportion (particle size distribution). The laser scattering method has a merit that it is easy, the application range of particle size measurement is broad and measurement by both a dry method and a wet method can be done, and therefore, it is generally used for particle size measurement.

However, in the laser scattering method, the particle diameter is obtained by assuming that the particles are spherical, but actual carrier particles have unevenness on the surface and are not perfectly spherical. In the laser scattering method, when fine particles having small particle diameters are present at positions to be shade of the particles having a large particle diameter viewed from the light source, the fine particles may not be irradiated with laser light, and the fine particles may not be accurately measured. That is, the particle size measurement by the laser scattering method has the following demerits.

(1) Since a refractive index of the particles is required, it cannot be said that it is an accurate measurement for particles and aggregates having a shape other than a sphere.

(2) The particle diameter/particle size distribution is different depending on the device/analysis device.

(3) The determined particle size distribution has low reliability because of numerical analysis.

Therefore, frequency of a particle group having a fine particle diameter, specified by the laser scattering method is insufficient to discuss carrier scattering.

In Patent Literature 2, the particle size distribution in which a ratio of number distribution and volume distribution is in a predetermined range, and the average particle diameter are specified, and a BET specific surface area of the carrier core material constituting the carrier particles is specified. According to Patent Literature 2, since the carrier core material has predetermined unevenness formed on the surface thereof, the reduction of the resin layer covering the surface of the carrier core material can be reduced even when the carrier particles are used as a developer for a long period of time.

However, even in the case of carrier particles having predetermined unevenness on the surface, chipping of a protruding portion on the surface of the particles due to collision between the particles cannot be prevented. In the case where chipping of the protruding portion occurs, fragments of the particles generated by the chipping may be scattered to damage the photoreceptor, the fixing roller and the like. In addition, when the surface of the carrier core material inside the resin layer is exposed due to the chipping, since the carrier core material itself has low resistance, carrier scattering may occur due to charge injection into the exposed low-resistance region.

CITATION LIST

Patent Literature

Patent Literature 1: JP-A-2005-250424
Patent Literature 2: JP-A-2008-26582

SUMMARY OF INVENTION

Technical Problem

Therefore, it is an object of the present invention to provide: a ferrite carrier core material for an electrophotographic developer that can reduce occurrence of carrier scattering and damage to a photoreceptor and a fixing roller caused by carrier scattering when it is used as an electrophotographic developer even if the particle size is small; a ferrite carrier; a method for producing them; and an electrophotographic developer using the ferrite carrier.

Solution to Problem

As a result of intensive studies to solve the problem as described above, the present inventors have found that the above problem can be solved by setting the content of the fine particles to a specific range or less and setting the particle strength to a specific range or less in the carrier particles.

The object of the present invention has been solved by the following means.

[1] A ferrite carrier core material for an electrophotographic developer, having a mesh-passing amount indicated by a ratio of weight of particles passing through a mesh having openings of 16 μm with respect to weight of entire particles constituting powder being 3% by weight or less, and having a particle strength index indicated by a difference between the mesh-passing amounts before and after a crushing treatment being 2% by weight or less.

[2] The ferrite carrier core material for an electrophotographic developer according to [1], having a relationship between a volume average particle diameter M1 (μm) and a BET specific surface area S ($m^2/g$) satisfying the following formulae:

$$-0.0039\times M1+0.270\leq S\leq -0.0039\times M1+0.315;\text{ and}$$

$$M1=24\text{ to }35\ (\mu m).$$

[3] The ferrite carrier core material for an electrophotographic developer according to [1] or [2], having an electric resistance R at a space between electrodes of 1.0 mm and an applied voltage of 500 V being $5.0\times10^5$ to $1.0\times10^9\Omega$, and having an apparent density D of 2.00 to 2.35 $g/cm^3$, in which the electric resistance R and the apparent density D satisfy the following formula:

$$12\leq \text{Log } R\times D\leq 17.$$

[4] The ferrite carrier core material for an electrophotographic developer according to any one of [1] to [3], having a magnetization of 50 to 65 $Am^2/kg$ by VSM measurement when a magnetic field of $1K\cdot1000/4\pi\cdot A/m$ is applied.

[5] The ferrite carrier core material for an electrophotographic developer according to any one of [1] to [4], represented by a composition formula $(MO)_x\cdot(Fe_2O_3)_y$ (here, M is at least one metal selected from the group consisting of Fe, Mg, Mn, Ca, Cu, Zn, Ni, Sr, Zr, and Si, and x+y=100 mol %).

[6] The ferrite carrier core material for an electrophotographic developer according to any one of [1] to [5], containing 15 to 22% by weight of Mn, 0.5 to 3% by weight of Mg, 45 to 55% by weight of Fe, and 0.1 to 3.0% by weight of Sr.

[7] A ferrite carrier for an electrophotographic developer, in which a surface of the ferrite carrier core material described in any one of [1] to [6] is covered with a resin.

[8] A method for producing a ferrite carrier core material for an electrophotographic developer, including firing a granulated substance having a content of particles having a particle diameter of 17 μm or less being 1.5% by weight or less and having a number frequency of particles having a circularity represented by the following formula of 0.80 or less being 12% or less:

Circularity=(perimeter of circle having the same area as projected image of particle)/(perimeter of projected image of particle).

[9] A method for producing a ferrite carrier for an electrophotographic developer, including covering a surface of the ferrite carrier core material obtained by the method described in [8] with a resin.

[10] An electrophotographic developer containing the ferrite carrier described in [7] and a toner.

[11] The electrophotographic developer according to [10], which is used as a replenishment developer.

Advantageous Effects of Invention

Since the ferrite carrier core material for an electrophotographic developer according to the present invention specifies an absolute amount of the fine particles by the mesh-passing amount, which is a weight ratio of the particles passing through a mesh having openings of 16 μm with respect to the weight of the entire particles, the content of the fine particles is more reliable as compared with a conventional carrier core material whose particle diameter is specified by a laser scattering method. In the present invention, since the fine particles that can pass through the mesh having openings of 16 μm are set to be 3% by weight or less of the weight of the entire particles constituting the powder, the content of the fine particles at a level of promoting carrier scattering can be reduced. Therefore, according to the carrier core material of the present invention, when it is used as an electrophotographic developer even in a small particle diameter, carrier scattering caused by the fine particles can be suppressed.

Since the particle strength index represented by the difference between the mesh-passing amounts before and after a crushing treatment (i.e., difference of the mesh-passing amount after the crushing treatment—the mesh-passing amount before the crushing treatment, specifically, formula (2) to be described later) is set to be 2% by weight or less, it is possible to prevent occurrence of chipping due to collision or the like between the particles even when it is used as an electrophotographic developer for a long period of time. Therefore, the carrier core material of the present invention can prevent scattering of fragments of the carrier core material caused by the chipping, and can prevent damage of the photoreceptor or the fixing roller by the scattered particles when it is used as the electrophotographic developer even in a small diameter. In addition, it is possible to prevent the surface of the carrier core material from being exposed due to chipping, and to reduce the occurrence of carrier scattering due to charge injection into an exposed portion.

In addition, the electrophotographic developer including a toner and the ferrite carrier obtained by covering the ferrite carrier core material with a resin can prevent carrier scattering in a real machine, and can give a printed matter having good thin line reproducibility continuously. According to the production method of the present invention, the ferrite carrier core material and the ferrite carrier can be obtained reliably.

DESCRIPTION OF EMBODIMENTS

In the specification, a numerical value range represented by using "to" means a range including numerical values described before and after "to" as a lower limit value and an upper limit value.

Embodiments for carrying out the present invention will be described below.

<Ferrite Carrier Core Material for Electrophotographic Developer and Ferrite Carrier for Electrophotographic Developer According to the Present Invention>

Ferrite particles used as a ferrite carrier core material for an electrophotographic developer (hereinafter, referred to as "carrier core material" in some cases) according to the present invention are characterized in that a mesh-passing amount indicated by a ratio of weight of particles passing through a mesh having openings of 16 μm to weight of entire particles constituting powder (hereinafter, also referred to as "mesh-passing amount") is 3% by weight or less, and a particle strength index indicated by a difference between the mesh-passing amounts before and after a crushing treatment is 2% by weight or less.

Since a content of fine particles capable of passing through the mesh having openings of 16 μm, that is, fine particles having a particle diameter of less than 16 μm is set to be 3% by weight or less of the weight of the entire particles constituting powder, the content of the fine particles at a level of promoting carrier scattering can be reduced as compared with a conventional carrier core material whose average particle diameter is specified by a laser scattering method. Therefore, according to the carrier core material of the present invention, in the case where it is used as an electrophotographic developer even when the powder includes a group of particles having a small particle diameter, it is possible to suppress carrier scattering caused by the fine particles.

In the case where the 16 μm-mesh-passing amount of the carrier core material is larger than 3% by weight of the weight of the entire particles constituting the powder, an absolute amount of the fine particles is large, and an image defect due to carrier scattering becomes prominent. The 16 μm-mesh-passing amount of the carrier core material is preferably 2.5% by weight or less, and more preferably 1.5% by weight or less.

The 16 μm-mesh-passing amount of the carrier core material is preferably 0.5% by weight or more. In the case of 0.5% by weight or more, a desired value can be obtained with a good yield during particle size adjustment.

As the particle diameter of the carrier core material is reduced, easiness of carrier scattering of the fine particles is rapidly increased. As disclosed in Patent Literature 1, conventional carrier particles specify particle size distribution of fine particles by a laser scattering method, and the particle size distribution has low reliability, so that an absolute amount of the fine particles cannot be grasped, and carrier scattering cannot be reliably reduced. However, the carrier core material of this embodiment specifies an absolute amount of the fine particles by the mesh-passing amount, and reliability on the absolute amount of the fine particles is higher than that in a method of specifying a content of the fine particles by the laser scattering method, so that carrier scattering can be reliably reduced.

(Mesh-Passing Amount)

The mesh-passing amount can be calculated by using, for example, a suction-type charge amount measurement device (q/m meter, Epping Co.). First, weight of a dedicated cell in which SV-Sieve SV-16/16tw (16 μm opening) manufactured by Asada Mesh Co., Ltd. is stretched is measured, 2.5000±0.0005 g of the carrier core material is weighed and loaded into the dedicated cell (this is taken as a load weight A), and weight B of the dedicated cell containing the carrier core material is measured. Subsequently, the dedicated cell containing the carrier core material is set in the suction-type charge amount measurement device and suctioned at a suction pressure of 105±5 mbar over 90 seconds, then the dedicated cell is removed, and weight C of the dedicated cell containing the carrier core material after suction is measured. Then, the mesh-passing amount of the carrier core material is determined based on the following formula (1).

$$\text{Mesh-passing amount (\% by weight)} = (\text{weight } B \text{ before suction} - \text{weight } C \text{ after suction})/\text{load weight } A \times 100(\%) \quad (1)$$

The mesh-passing amount in the present specification is a value calculated by using the above-mentioned suction-type charge amount measurement device (q/m meter, Epping Co.).

Furthermore, since the particle strength index is set to be 2% by weight or less, even when the carrier core material is used as a developer for a long period of time, it is possible to prevent occurrence of chipping due to collision between particles, or the like. Therefore, in the case where the carrier core material is used as an electrophotographic developer, it is possible to prevent scattering of fragments of the ferrite carrier core material caused by chipping and to prevent damage to the photoreceptor or the fixing roller due to the scattered particles. In addition, it is possible to prevent exposure of the ferrite carrier core material due to chipping and to further reduce occurrence of carrier scattering. In particular, in a carrier core material having a large specific surface area, since a load on a protruding portion due to collision between particles or the like increases, it is important that particle strength is high.

On the other hand, the carrier core material having a particle strength index of more than 2% by weight is insufficient in strength, chipping may occur and carrier scattering may occur due to the collision between particles or the like, and the photoreceptor or fixing roller may be damaged by the scattered particles in some cases.

(Particle Strength Index)

The particle strength index can be calculated from the difference between the mesh-passing amounts before and after applying a crushing treatment to the carrier core material. First, mesh-passing amount X before a crushing treatment of the carrier core material weighed to have a volume of 30 mL is determined in the same manner as in the above-described (mesh-passing amount) except for the weighing of the carrier core material. Subsequently, the carrier core material is housed in a sample case (inner diameter φ78 mm×inner height 37 mm, made of stainless steel) of a sample mill (SK-M2, Kyoritsu-Riko Co.) as a small pulverizer, and stirred at a rotational speed of 15,000 rpm (during non-load) over 30 seconds by using a motor of AC 100 V, 120 W, and 2.7 A, thereby applying a crushing treatment. M2-04 (Kyoritsu-Riko Co.) is used as a crushing blade in the sample mill, and a new crushing blade is used for each crushing treatment. Next, the mesh-passing amount after the crushing treatment of the carrier core material after the crushing treatment is determined in the same manner as the mesh-passing amount X before the crushing treatment as described above as the mesh-passing amount Y after the crushing treatment. Then, the particle strength index is determined based on the following formula (2).

$$\text{Particle strength index (\% by weight)} = \text{mesh-passing amount } Y \text{ after crushing treatment (\% by weight)} - \text{mesh-passing amount } X \text{ before crushing treatment (\% by weight)} \quad (2)$$

The ferrite particles used as the ferrite carrier core material for an electrophotographic developer according to the present invention has a relationship between a volume average particle diameter M1 (μm) and a BET specific surface area S ($m^2/g$) preferably satisfying the following formula (3). In the formula (3), the volume average particle diameter M1 is 24 to 35 μm.

$$-0.0039 \times M1 + 0.270 \leq S \leq -0.0039 \times M1 + 0.315 \quad (3)$$

The carrier core material needs to maintain surface properties appropriately in accordance with the particle diameter in order to improve charge-imparting properties to a toner and to reduce chipping of a surface protruding portion due to peeling of a resin layer (coat layer), collision or the like in the case where the surface is covered with a resin. Since the relationship between the volume average particle diameter M1 (μm) and the BET specific surface area S ($m^2/g$) satisfies the above formula (3) in the range of M1=24 to 35 μm, to the carrier core material can reduce charge-imparting to the toner and to reduce peeling of the resin layer and chipping of the protruding portion.

On the other hand, in the case where the BET specific surface area S is lower than the lower limit value, unevenness of the carrier core material surface with respect to the particle diameter is insufficient, so that the coat layer is easily peeled off due to abrasion when the surface of the carrier core material is covered with a resin. In this case, the carrier core material having low resistance is exposed, and an image defect due to carrier scattering and decrease in electrostatic properties easily occurs. In addition, in the case where the BET specific surface area S is more than the upper limit value, unevenness on the carrier core surface with respect to the particle diameter is excessive, so that it may be difficult to cover the protruding portion with the resin, and sufficient electrostatic properties cannot be maintained by the resin covering in some cases. In addition, since the protruding portion of the carrier core material becomes excessively sharp and insufficient in strength, chipping easily occurs due to collision between particles or the like.

Since the carrier core material has a volume average particle diameter M1 of 24 to 35 μm, the charge-imparting properties to the toner is high, and the charge-imparting properties can be maintained even though it is used for a long period of time as a developer. In the case where the volume average particle diameter M1 is less than 24 μm, aggregation easily occurs during resin covering, the aggregation may loosen when it is used as a developer to expose a region not covered with the resin on the carrier core material surface, and the charge-imparting properties to the toner may decrease in some cases. In the case of more than 35 μm, since the surface area is reduced, the charge-imparting properties to the toner may be insufficient in some cases. In addition, in the case of more than 35 μm, even though the surface area is increased by increasing the unevenness of the carrier core material surface, the charge-imparting properties to the toner are improved, but the unevenness is excessive to the particle diameter, and the strength cannot be maintained in some cases.

(Volume Average Particle Diameter)

The volume average particle diameter can be measured by any method, for example, can be measured by a microtrack particle size analyzer (Model 9320-X100, Nikkiso Co., Ltd.) using a laser diffraction scattering method. First, the carrier core material is dispersed in a dispersion liquid by applying an ultrasonic treatment for one minute with an ultrasonic homogenizer (UH-3C, Ultrasonic Engineering Co., Ltd.) by using a 0.2% sodium hexametaphosphate aqueous solution as the dispersion liquid. Subsequently, a measurement is performed by the microtrack particle size analyzer by setting a refractive index to 2.42 and in an environment of a temperature of 25±5° C. and a humidity of 55±15%. The volume average particle diameter referred to here is a cumulative 50% particle diameter of a minus sieve in a volume distribution mode.

(BET Specific Surface Area)

The BET specific surface area can be measured by using a specific surface area measurement device (Macsorb HM model-1208, Mauntec Corporation). First, the carrier core material is weighed out about 20 g in a glass Petri dish and then degassed to −0.1 MPa with a vacuum dryer, it is confirmed that a degree of vacuum reaches −0.1 MPa or less, and then a pretreatment is applied by heating at 200° C. over 2 hours. Subsequently, about 5 to 7 g of the carrier core material that has been subjected to the pretreatment is put in a standard sample cell dedicated to the specific surface area measurement device and accurately weighed with a precision balance, and measurement is started by setting the sample in a measurement port. The measurement is performed at a temperature of 10 to 30° C. and a relative humidity of 20 to 80% by a one-point method. When the weight of the sample is input at the end of measurement, the BET specific surface area is automatically calculated.

It is preferable that the ferrite particles used as the ferrite carrier core material for an electrophotographic developer according to the present invention have an electric resistance R of $5.0 \times 10^5$ to $1.0 \times 10^9 \Omega$ at a space between electrodes of 1.0 mm and an applied voltage of 500 V and have an apparent density D of 2.00 to 2.35 $g/cm^3$, and that the electric resistance R and the apparent density D satisfy the following formula.

$$12 \leq \text{Log } R \times D \leq 17$$

In the case where the resistance is less than $5.0 \times 10^5 \Omega$, the resistance is too low and white spots may be generated or carrier scattering may occur when it is used as a ferrite carrier. In the case of more than $1.0 \times 10^9 \Omega$, an image edge may be too sharp when it is used as a ferrite carrier, and a toner consumption amount may increase in some cases, which is not preferable. In addition, in the case where the apparent density is less than 2.00 $g/cm^3$, the charge-imparting properties to the toner may decrease due to carrier scattering due to decrease in strength or flowability deterioration. In the case of more than 2.35 g/cm$^3$, stirring stress may increase and cracking of the carrier and abrasion of the covering layer may occur, which may cause increase of carrier scattering and decrease of the charge-imparting properties to the toner same as in the case of less than 2.00 g/cm$^3$, which is not preferable. From the above, by setting the apparent density and the level of resistance within certain ranges, it is possible to further improve effects of suppressing carrier scattering and stabilizing imaging characteristics in the case of being used as a developer.

(Electric Resistance)

The resistance can be measured as the following. First, non-magnetic parallel plate electrodes (10 mm×40 mm) are opposed with a space between the electrodes of 1.0 mm, and 200 mg of the carrier core material as a sample is weighed and filled between the electrodes. Subsequently, the sample is held between the electrodes by attaching a magnet (surface magnetic flux density: 1,500 Gauss, contact area to the electrode: 10 mm×30 mm) to the parallel plate electrodes, and resistance at an applied voltage of 500 V is measured by ELECTROMETER/HIGH RESISTANCE METER (6517 A, KEITHLEY).

(Apparent Density)

The apparent density can be measured in accordance with JIS (Japanese Industrial Standard) Z2504 (Test Method for Apparent Density of Metal Powder).

The ferrite particle used as the ferrite carrier core material for an electrophotographic developer according to the present invention preferably has a surface oxide film covering a surface thereof. The surface oxide film may be uniformly formed on the surface of the ferrite particles, and the surface oxide film may be partially formed. The surface oxide film can be formed by a surface oxidation treatment of the ferrite particles. In the ferrite particles provided with the surface oxide film, not only the resistance is improved by the surface oxidation treatment, but also distribution of the resistance is made uniform, so that occurrence of carrier scattering can be further suppressed.

The ferrite carrier core material for an electrophotographic developer according to the present invention preferably has a magnetization of 50 to 65 Am$^2$/kg by VSM measurement when a magnetic field of 1K·1000/4π·A/m is applied. In the case where the magnetization is less than 50 Am$^2$/kg, magnetization of a scattering object deteriorates, which causes an image defect due to carrier adhesion, and the magnetization will not be more than 65 Am$^2$/kg in the composition range of the present invention to be described later.

(Magnetic characteristics)

The magnetic characteristics (magnetization) can be measured as the following. First, a carrier sample is filled in a cell having an inner diameter of 5 mm and a height of 2 mm, which is set in a vibration sample-type magnetic measurement device (VSM-C7-10A, Toei Industry Co., Ltd.). Subsequently, a magnetic field is applied to sweep up to 1 KOe, and then the applied magnetic field is reduced, thereby create a hysteresis curve on recording paper. The magnetization (saturation magnetization) is determined from the obtained hysteresis curve.

The ferrite particles used as the ferrite carrier core material for an electrophotographic developer according to the present invention can be represented by a composition formula $(MO)_x.(Fe_2O_3)_y$. Here, M is at least one metal selected from the group consisting of Fe, Mg, Mn, Ca, Cu, Zn, Ni, Sr, Zr, and Si, and x+y=100 mol %. For example, when the ferrite particles are represented by a composition formula $(MO)_{0.3}.(Fe_2O_3)_{0.7}$, it means that 1 mol of the ferrite particles are composed of 0.3 mol of MO and 0.7 mol of $Fe_2O_3$.

The ferrite particles preferably contain 15 to 22% by weight of Mn, 0.5 to 3.0% by weight of Mg, 45 to 55% by weight of Fe, and 0.1 to 3.0% by weight of Sr with respect to the total weight of the ferrite particles. The content of Mn is preferably 17 to 22% by weight, and more preferably 18 to 21% by weight; and the content of Mg is preferably 0.5 to 2.5% by weight, and more preferably 0.5 to 2% by weight. The content of Fe is preferably 47 to 55% by weight, and more preferably 48 to 55% by weight. The content of Sr is preferably 0.3 to 2.0% by weight, and more preferably 0.5 to 1.0% by weight. The balance is O (oxygen) and accompanying impurities (inevitable impurities); and the accompanying impurities are contained in raw materials and are incorporated in a production step, and a total amount thereof is 0.5% by weight or less.

By containing Mn, magnetization on a low magnetic field side can be increased, and an effect of preventing re-oxidation when putting out of a furnace in main firing can be expected. A form of Mn at the time of addition is not particularly limited, but $MnO_2$, $Mn_2O_3$, $Mn_3O_4$, and $MnCO_3$ are preferable, because they are easily obtained in industrial applications. In the case where the content of Mn is less than 15% by weight, the content of Fe relatively increases. As a result, since a large number of magnetite components are present and magnetization on the low magnetic field side is low, not only carrier adhesion is made to occur, the resistance is also low, so that an image quality deteriorates due to occurrence of fog, deterioration in gradation, and the like. In the case where the content of Mn is more than 22% by weight, an image edge may be too sharp since the resistance is high, an image defect such as a blind spot may occur, and the toner consumption amount may increase in some cases.

By containing Mg, it is possible to obtain a developer having a good rise in charge, composed of the ferrite carrier and a toner for full color. Further, the resistance can be increased. In the case where the content of Mg is less than 0.5% by weight, a sufficient addition effect cannot be obtained, and in the case where the content of Mn is relatively small and the content of Fe is large, the resistance lowers, and the image quality deteriorates due to occurrence of fog, deterioration of gradation, and the like. In the case where the content of Mn is relatively large and the content of Fe is small, the magnetization becomes too high, so that bristles of a magnetic brush becomes hard, which causes an image defect such as a brush stroke. On the other hand, in the case where the content of Mg is more than 3.0% by weight, not only carrier scattering occurs because magnetization decreases, but a moisture adsorption amount also increases by an influence of hydroxyl group caused by Mg when the firing temperature is low, which causes deterioration of environmental dependency of electric characteristics such as a charge amount and resistance.

In the case where the content of Fe is less than 45% by weight, in the case where the content of Mg relatively increases, it means that low magnetization components increase, and desired magnetic characteristics cannot be obtained. In the case where the content of Mn relatively increases, since the magnetization is too high, bristles of the magnetic brush may become hard, which causes an image defect such as a brush stroke, and since the resistance is high, an image edge may be too sharp, and an image defect such as a blind spot may occur, and the toner consumption amount may increase too much in some cases. In the case where the content of Fe is more than 55% by weight, effects of containing Mg and/or Mn are not obtained, resulting in a ferrite carrier core material substantially equivalent to magnetite.

Sr contributes to adjustment of resistance and surface properties, and not only has an effect of maintaining high magnetization during surface oxidation, but also has an effect of improving a charging ability of the core material when it is contained. In the case where the content of Sr is less than 0.1% by weight, an effect of containing Sr cannot be obtained. In particular, when printing of a photograph or the like is continuously performed at a high coverage rate, there is a possibility that charge reduction may occur to cause a problem such as toner scattering or an increase in toner consumption. In the case where the content of Sr is more than 3.0% by weight, magnetization of the core particles decreases and carrier scattering occurs, or residual magnetization and coercive force increase, an image defect such as a brush stroke occurs and the image quality decreases when the carrier particles are used as a developer.

(Contents of Fe, Mn, Mg, and Sr)

The contents of Fe, Mn, Mg, and Sr described above are measured by the following.

The carrier core material (ferrite particles) is weighed out 0.2 g, and 20 mL of 1 N hydrochloric acid and 20 mL of 1 N nitric acid are added to 60 mL of pure water and heated to prepare an aqueous solution in which the carrier core material is completely dissolved. The aqueous solution containing the carrier core material is set in an ICP analyzer (ICPS-1000IV, Shimadzu Corporation), and the contents of Fe, Mn, Mg, and Sr are measured.

In the ferrite carrier for an electrophotographic developer according to the present invention, a surface of the carrier core material (ferrite particles) is preferably covered with a resin. The number of times of resin-covering may be only once or twice or more times resin-covering may be performed, and the number of times of covering can be determined in accordance with desired characteristics. A composition of the covering resin, a covering amount and a device used for resin-covering may be changed or may not be changed in the case where the number of times of covering is twice or more times.

In the ferrite carrier for an electrophotographic developer according to the present invention, a total resin film amount is desirably 0.1 to 10% by weight with respect to the carrier core material. In the case where the total film amount is less than 0.1% by weight, it is difficult to form a uniform film layer on the carrier surface, and in the case of more than 10% by weight, aggregation between the carriers occurs, which causes a decrease in productivity such as a decrease in yield, and variation in developer characteristics such as flowability or a charge amount in an actual machine.

The film-forming resin used here can be appropriately selected depending on a toner to be combined, an environment to be used, and the like. A type thereof is not particularly limited, and examples thereof include a fluorine resin, an acrylic resin, an epoxy resin, and a polyamide resin, a polyamide-imide resin, a polyester resin, an unsaturated polyester resin, a urea resin, a melamine resin, an alkyd resin, a phenol resin, a fluorine acrylic resin, an acrylic-styrene resin, a silicone resin, or a modified silicone resin modified with resins such as an acrylic resin, a polyester resin, an epoxy resin, a polyamide resin, a polyamide-imide resin, an alkyd resin, a urethane resin, and a fluorine resin. In the present invention, an acrylic resin, a silicone resin, or a modified silicone resin are most preferably used.

For the purpose of controlling electric resistance, a charge amount, and charging speed of the carrier, a conductive agent can be contained in the film-forming resin. Since electric resistance of the conductive agent itself is low, when the content is too large, rapid charge leakage is easily caused. Therefore, the content is 0.25 to 20.0% by weight, preferably 0.5 to 15.0% by weight, and particularly preferably 1.0 to 10.0% by weight with respect to a solid content of the film-forming resin. Examples of the conductive agent include conductive carbon, carbon nanotubes having metallic properties, carbon nanotubes having semiconductor properties, oxides such as a titanium oxide and a tin oxide, and various organic conductive agents.

Furthermore, a charge control agent can be contained in the film-forming resin. Examples of the charge control agent include various charge control agents commonly used for toners and various silane coupling agents. This is because, in the case where an exposed area of the core material is controlled to be relatively small by film formation, the charge-imparting ability may be lowered, but can be controlled by adding various charge control agents and silane coupling agents. The type of the charge control agent or coupling agent that can be used is not particularly limited, but a charge control agent such as a nigrosine dye, a quaternary ammonium salt, an organometallic complex, and a metal-containing monoazo dye, an aminosilane coupling agent, a fluorine-silane coupling agent and the like are preferable. The content of the charge control agent is preferably 1.0 to 50.0% by weight, more preferably 2.0 to 40.0% by weight, and particularly preferably 3.0 to 30.0% by weight with respect to the solid content of the film-forming resin. In the case where the content of the charge control agent is less than 1% by weight, there is no containing effect, and even though it is contained more than 50% by weight, a further improved containing effect cannot be obtained, which is economically disadvantageous. In addition, in the case of an excessively large amount, problems may occur in the compatibility with the covering resin, which is not preferable because a non-uniform resin mixture is easily formed.

<Method for Producing Carrier Core Material for Electrophotographic Developer and Carrier for Electrophotographic Developer According to the Present Invention>

Next, the methods for producing the carrier core material for an electrophotographic developer and a carrier for an electrophotographic developer according to the present invention will be described.

The carrier core material can be obtained by a production method including at least a pulverization and mixing step of a ferrite raw material, a main granulation step and a main firing step. The method for producing the carrier core material of the present invention is characterized by firing a granulated substance satisfying specific conditions.

The production processes of the pulverization and mixing step of the ferrite raw material, the main granulation step and the main firing step are not particularly limited, and conventionally known methods can be adopted, and a dry method may be used and a wet method may be used. After the pulverization and mixing step, a calcination step and a re-pulverization and mixing step may be provided.

For example, as the ferrite raw materials, $Fe_2O_3$, $Mg(OH)_2$ and/or $MgCO_3$, one or more kinds of a manganese compound selected from $MnO_2$, $Mn_2O_3$, $Mn_3O_4$, and $MnCO_3$, and SrO and/or $SrCO_3$ are pulverized and mixed (pulverization and mixing step of ferrite raw materials), and calcined in air (calcination step). After the calcination, the obtained calcined product is further re-pulverized with a ball mill, a vibration mill or the like, and then water is added thereto to obtain a slurry having a raw material solid content ratio of 40 to 60%. During the re-pulverization, during pulverization after the calcination, pulverization may be performed with a wet ball mill, a wet vibration mill or the like by adding water. If necessary, a dispersant, a binder and the like are added to the obtained slurry (re-pulverization and mixing step), and the viscosity is adjusted to 2 to 4 poise (P). Polyvinyl alcohol or polyvinyl pyrrolidone is preferably used as the binder. It should be noted that 10 P=1 Pa·s.

Next, the viscosity-adjusted slurry is sprayed in a spray dryer under conditions of a discharge rate of 20 to 50 Hz, an atomizer disk rotation speed of 11,000 to 20,000 rpm, and a drying temperature of 100 to 500° C., and granulated and dried to obtain a granulated substance (main granulation step).

Subsequently, the obtained granulated substance is fired to obtain the carrier core material, but at that time, the present inventors have found that in the case where there are many fine particles contained in the granulated substance, particularly when the content of particles having a particle diameter of 17 μm or less is more than 1.5% by weight or when the content of irregular-shaped particles that are non-spherical is large, particularly when number frequency of particles having a circularity of 0.80 or less to be described below is more than 12%, carrier scattering occurs in the carrier core material obtained by firing the granulated substance.

Therefore, in the present invention, first, at least one of the following conditions (1) to (4) is controlled so that the circularity of the obtained granulated substance is in a desired range close to 1 in the main granulation step:

(1) Solid content ratio and viscosity of the slurry as a granulated dispersion liquid;

(2) Discharge amount during spraying of the slurry;

(3) Atomizer disk rotation speed of spray dryer; and (4) Drying temperature of spray dryer.

Further, the granulated substance obtained in the main granulation step is classified before firing, and fine particles contained in the granulated substance are removed (classification step). The classification can be performed by using a known air flow classification, a sieve or the like. In the present invention, the classification is performed so that the obtained granulated substance has a content of the particles having a particle diameter of 17 μm or less being 1.5% by weight or less. As a result, a granulated substance can be obtained, in which the content of particles having a particle diameter of 17 μm or less is 1.5% by weight or less, and number frequency of particles having a circularity of 0.80 or less is 12% or less. The granulated substance after classification preferably has a volume average particle diameter M2 of 33 to 47 μm.

(Circularity)

Circularity of the granulated substance is calculated as follows. As measurement principles, the carrier particles flowing in a dispersion medium flow are photographed as a still image by using a particle size-shape distribution-measuring apparatus (PITA-1, Seishin Enterprise Co., Ltd.).

First, in a beaker is put 0.1 g of the classified granulated substance, and thereto is added silicone oil as a dispersion medium, and then stirred with a glass rod and dispersed to prepare a sample liquid. Then, the sample liquid is passed through a cell under conditions where a flow rate of the sample liquid is 0.08 μL/sec, a flow rate of a first carrier liquid is 10 μL/sec, and a flow rate of a second carrier liquid is 10 μL/sec. Next, while a binarization processing is performed with setting a binarization first level for determining particles to be captured to 80 and setting a binarization second level for determining a contour of the captured particles to 200, the granulated substance passing through the cell is photographed with a monochrome CCD camera having an objective lens (magnification: 10 times), to thereby obtain a projected image of the granulated substance.

From the projected images of about 3,000 captured granulated substances, an area and perimeter of the projected image of each granulated substance are measured and a perimeter of circles having the same area as the area is calculated. Then, the circularity of each carrier particle is calculated based on the following formula (4). The circularity is a positive number of 100 or less, and the circularity of a perfect circle is 100.

$$\text{Circularity}=(\text{perimeter of circle having the same area as projected image of particle})/(\text{perimeter of projected image of particle}) \quad (4)$$

A reason why carrier scattering occurs in the developer using the carrier core material obtained by firing the granulated substance in the case where the content of the particles having a particle diameter of 17 μm or less is more than 1.5% by weight or in the case where the number frequency of the particles having circularity of 0.80 or less is more than 12% in the granulated substance is considered as follows.

In the case where the content of the particles having a particle diameter of 17 μm or less in the granulated substance is more than 1.5% by weight, a content of fine sintered particles obtained by sintering the fine particles increases in the carrier core material obtained by firing. In the case where these fine sintered particles adhere to the surface of other sintered particles or form secondary particles by aggregation, the fine sintered particles cannot be sufficiently removed even if classification of the carrier core material is performed. When the carrier core material containing many fine sintered particles is used in a developer, the fine sintered particles fall off from the surface of other particles or the secondary particles due to a collision between the carrier core materials and the like, and carrier scattering occurs due to the fallen fine sintered particles. Therefore, it is important to reduce the content of the particles having a particle size of 17 μm or less to a certain amount or less at a stage of the granulated substance before firing.

In the case where the number frequency of the particles having the circularity of 0.80 or less in the granulated substance is more than 12%, a content of irregular shaped sintered particles obtained by sintering the irregular shaped particles increases in the carrier core material obtained by firing. The irregular shaped particles referred to here also include the secondary particles in which the primary particles are aggregated. For example, in the case where the irregular shaped particles are particles having excessively large unevenness on the surface, outer shapes of the particles are substantially maintained even after sintering, resulting in the irregular shaped sintered particles. When the carrier core material containing many irregular shaped sintered particles is used in a developer, the protruding portion of the irregular shaped sintered particles is chipped due to a collision between the carrier core materials and the like, and carrier scattering occurs due to fragments generated by the chipping.

Next, the classified granulated substance is fired. In the production method of the present invention, the obtained granulated substance is subjected to a primary firing (primary firing step) as necessary, and then subjected to the main firing (main firing step). Here, the primary firing is performed at 600 to 800° C. The main firing can be performed at a temperature of 1,120 to 1,220° C. in an inert atmosphere or a weakly-oxidizing atmosphere, for example, in a mixed gas atmosphere of nitrogen gas and oxygen gas having an oxygen gas concentration of 0.1% by volume (1,000 ppm) to 5% by volume (50,000 ppm), more preferably 0.1% by volume (1,000 ppm) to 3.5% by volume (35,000 ppm), and most preferably 0.1% by volume (1,000 ppm) to 2.5% by volume (25,000 ppm). In the case where the temperature in the main firing is lower than 1,120° C., sintering may not proceed sufficiently, sometimes the strength cannot be sufficiently improved or the resistance cannot be sufficiently improved, and in the case of higher than 1,220° C., sintering may excessively proceed, and proper surface properties may not be obtained.

When the main firing is performed, a firing furnace of a form in which an object passes through a hot portion while flowing inside the furnace, such as a rotary kiln, the object easily adheres inside the furnace in the case where an oxygen gas concentration in the firing atmosphere is low, and is discharged out of the furnace before the fired product having good flowability is sufficiently fired. Therefore, even though the BET specific surface area is approximately the same as the range specified in the present invention, there is possibility that sintering inside the particles does not proceed even sintering of the surface of the core particles sufficiently proceeds, and the ferrite particles may not have sufficient strength as the ferrite carrier core material for an electrophotographic developer. For this reason, it is desirable to use a tunnel kiln, an elevator kiln or the like which allows the raw material before firing is passed through a hot portion in a state of being put in a saggar or the like and left to stand, as much as possible.

Thereafter, the fired product is crushed and classified to obtain the ferrite particles. The particle size is adjusted to a desired particle diameter by using existing wind classification, a mesh filtration method, a precipitation method, or the like as a classification method. In the case where dry recovery is performed, it can also be recovered by cyclone or the like. When the particle size is adjusted, two or more types of the classification method may be selected and carried out, coarse powder side particles and fine powder side particles may be removed by changing conditions in one classification method.

As described above, according to the production method of the present invention, it is possible to obtain a carrier core material in which the mesh-passing amount is 3% by weight or less and the particle strength index is 2% by weight or less.

In the case where the content of the particles having a particle diameter of 17 μm or less is more than 1.5% by weight in the granulated substance to be fired, a carrier core material having a mesh-passing amount of 3% by weight or less cannot be obtained. In the case where the number frequency of particles having the circularity of 0.80 or less is more than 12% in the granulated substance, a carrier core material having a particle strength index of 2% by weight or less cannot be obtained. In the case where the volume average particle diameter M2 is less than 33 μm or more than 47 μm in the granulated substance, a carrier core material having a volume average particle diameter M1 of 24 to 35 μm may not be obtained, or the productivity may be significantly lowered.

There has been a known technique for removing coarse particles and fine particles by classifying the granulated substance before firing, but the particle size distribution becomes excessively sharp only by simply removing the particles, and there is a problem that the productivity of the carrier core material is lowered. In contrast, in the production method of the present invention, a granulated substance having a content of particles having a particle diameter of 17 μm or less being 1.5% by weight or less and number frequency of particles having the circularity of 0.80 or less being 12% or less, can be obtained through classification. As a result, it is possible to prevent the particle size distribution from becoming too sharp, and to suppress a decrease in productivity of the carrier core material. Further, by firing such a granulated substance, it is possible to obtain a carrier core material that satisfies the above conditions and can suppress occurrence of carrier scattering.

In the production method of the present invention, since a granulated substance having the circularity in a desired range close to 1 is obtained by controlling the conditions (1) to (4) during spraying by a spray dryer in the main granulation step, the granulated substance having the number frequency of particles having circularity of 0.80 or less being 12% or less can be obtained by classification. By firing such a granulated substance, it is possible to suppress the carrier core material from containing the secondary particles and the irregular shaped particles.

In order to suppress the carrier core material from containing the secondary particles and the irregular shaped particles, a method of intentionally loosening the secondary particles by disaggregating the fired product and a method of preventing generation of the secondary particles or irregular shaped particles by suppressing progress of sintering by adjusting the firing temperature and oxygen gas concentration in the firing step, can be considered. However, when a sharp protruding portion is formed on the surface of a particle which is a fired product or surface properties of the particles become not uniform by disaggregation, there is concern about the occurrence of carrier scattering. In addition, it is difficult to adjust the firing temperature and oxygen gas concentration in the firing step since they affect the resistance, magnetization and surface properties of the carrier core material. For the above reasons, in order to suppress the carrier core material from containing the secondary particles and the irregular shaped particles, it is desirable to adjust the circularity during granulation.

After that, the carrier core material obtained by the production method of the present invention may be subjected to a surface oxidation treatment by heating the surface at a low temperature to form a surface oxide film on the surface of the ferrite particles, to thereby adjust the electric resistance (surface oxidation treatment step). In the surface oxidation treatment, heating treatment is performed at a temperature of 450 to 730° C., preferably 500 to 650° C. by using a general rotary electric furnace, a batch type electric furnace or the like under an oxygen gas-containing atmosphere such as air. In the case where the heating temperature is lower than 450° C., since oxidation of the core material particle surface does not proceed sufficiently, desired resistance characteristics cannot be obtained. In the case where the heating temperature is higher than 730° C., oxidation of manganese proceeds excessively, and the magnetization of the ferrite particles is reduced, which are not preferable. In order to uniformly form the surface oxide film on the ferrite particles, the rotary electric furnace is preferably used.

The ferrite carrier for an electrophotographic developer can be formed by further covering the surface of the carrier core material with the film-forming resin described above. The carrier core material used for the ferrite carrier may include or may not include an oxide film on the surface.

Covering can be performed by a known method such as a brush painting method, a spray drying method using a fluidized bed, a rotary dry method, an immersion drying method using a universal stirrer, or the like as a method of covering with a resin. In order to improve the coverage, a method using a fluidized bed is preferable.

In the case where the carrier core material is covered with the resin and then baked, any of an external heating method and an internal heating method may be used, for example, a fixed or fluidized electric furnace, a rotary electric furnace or a burner furnace can be used. Alternatively, baking may be performed by using a microwave. In the case where a UV-curing resin is used as the film-forming resin, a UV heater is used. Although a temperature of the baking varies depending on the resin used, a temperature above a melting point or a glass transition point is necessary, and in the case of a thermosetting resin, a condensation-crosslinking resin, or the like, it is necessary to raise the temperature to a temperature at which curing proceeds sufficiently.

<Electrophotographic Developer According to the Present Invention>

Next, the electrophotographic developer according to the present invention will be described.

The electrophotographic developer according to the present invention contains the ferrite carrier for an electrophotographic developer described above and a toner.

A toner particle constituting the electrophotographic developer of the present invention includes a pulverized toner particle produced by a pulverizing method and a polymerized toner particle produced by a polymerization method. The toner particle obtained by any method can be used in the present invention.

The pulverized toner particles can be obtained, for example, by thoroughly mixing a binder resin, a charge control agent and a coloring agent with a mixer such as a Henschel mixer, subsequently, melt-kneading in a twin-screw extruder or the like, then, cooling, pulverizing, classifying, adding external additives, and then mixing with a mixer or the like.

The binder resin constituting the pulverized toner particles is not particularly limited. Examples thereof include polystyrene, chloropolystyrene, styrene-chlorostyrene copolymer, styrene-acrylate ester copolymer, and styrene-methacrylate ester copolymer, as well as rosin-modified maleic acid resin, epoxy resin, polyester resin, polyurethane resin and the like. These may be used alone or in combination.

As the charge control agent, any agent can be used. Examples for the positively chargeable toner include nigrosin dyes, quaternary ammonium salts and the like, and examples for the negatively chargeable toner include metal-containing monoazo dyes and the like.

As the coloring agent (color material), conventionally-known dyes and pigments can be used. For example, carbon black, phthalocyanine blue, permanent red, chrome yellow, phthalocyanine green, or the like can be used. In addition, an external additive such as silica powder and titania for improving fluidity and aggregation resistance of the toner can be added according to the toner particles.

Polymerized toner particles are toner particles produced by known methods such as a suspension polymerization method, an emulsion polymerization method, an emulsion aggregation method, an ester elongation polymerization method, and a phase inversion emulsification method. As for such polymerized toner particles, for example, a colored dispersion prepared by dispersing a coloring agent in water by using a surfactant is mixed with a polymerizable monomer, a surfactant and a polymerization initiator in an aqueous medium under stirring to emulsifying and dispersing the polymerizable monomer in the aqueous medium, polymerization is performed under stirring and mixing, and then, a salting-out agent is added thereto to salt out the polymer particles. The particles obtained by salting-out are filtered, washed, and dried to obtain polymerized toner particles. Thereafter, an external additive can also be added for imparting a function to the dried toner particles as required.

Furthermore, when producing the polymerized toner particles, a fixing property improver and a charge-controlling agent can be blended in addition to the polymerizable monomer, surfactant, polymerization initiator, and coloring agent such that various properties of the thus-obtained polymerized toner particles can be controlled and improved. In addition, a chain transfer agent can be used to improve the dispersibility of the polymerizable monomer in the aqueous medium and to adjust the molecular weight of the obtained polymer.

The polymerizable monomer used for producing the polymerized toner particles is not particularly limited. Examples thereof include styrene and its derivatives; ethylenically unsaturated monoolefins such as ethylene and propylene; halogenated vinyls such as vinyl chloride; vinyl esters such as vinyl acetate; α-methylene aliphatic monocarboxylic acid esters such as methyl acrylate, ethyl acrylate, methyl methacrylate, ethyl methacrylate, 2-ethylhexyl methacrylate, dimethylamino acrylate, and diethylamino methacrylate; and the like.

Conventionally known dyes and pigments can be used as the coloring agent (coloring material) used for preparing the polymerized toner particles. For example, carbon black, phthalocyanine blue, permanent red, chrome yellow, phthalocyanine green and the like can be used. The surface of these coloring agents may be modified by using a silane coupling agent, a titanium coupling agent or the like.

An anionic surfactant, a cationic surfactant, an amphoteric surfactant, and a nonionic surfactant can be used as the surfactant used for producing the polymerized toner particles.

Examples of the anionic surfactant include aliphatic acid salts such as sodium oleate and castor oil, alkyl sulfate esters such as sodium lauryl sulfate and ammonium lauryl sulfate, alkyl benzene sulfonates such as sodium dodecyl benzene sulfonate, alkyl naphthalene sulfonate salts, alkylphosphorate ester salts, naphthalenesulfonate formaldehyde condensate, polyoxyethylene alkylsulfurate ester salts, and the like. Examples of the nonionic surfactant include polyoxyethylene alkyl ethers, polyoxyethylene fatty acid esters, sorbitan fatty acid esters, polyoxyethylene alkylamines, glycerin, fatty acid esters, oxyethylene-oxypropylene block polymers, and the like. Furthermore, examples of the cationic surfactant include alkylamine salts such as laurylamine acetate, quaternary ammonium salts such as lauryltrimethylammonium chloride and stearyltrimethylammonium chloride, and the like. Examples of the amphoteric surfactants include aminocarboxylic acid salts and alkylamino acids.

The surfactant as described above can usually be used in an amount within the range of from 0.01% to 10% by weight based on the polymerizable monomer. Such a surfactant affects dispersion stability of monomers and also affects environmental dependency of the obtained polymerized toner particles. It is preferable to use in an amount within the above-described range in view that the dispersion stability of monomers is secured and the environment dependency of the polymerized toner particles is reduced.

In the production of the polymerized toner particles, a polymerization initiator is usually used. The polymerization initiator includes a water-soluble polymerization initiator and an oil-soluble polymerization initiator, and any of them can be used in the present invention. Examples of the water-soluble polymerization initiator that can be used in the present invention include persulfates such as potassium persulfate and ammonium persulfate, and water-soluble peroxide compounds, and examples of the oil-soluble polymerization initiator include azo compounds such as azobisisobutyronitrile and oil-soluble peroxide compounds.

In the case where a chain transfer agent is used in the present invention, examples of the chain transfer agent include mercaptans such as octyl mercaptan, dodecyl mercaptan and tert-dodecyl mercaptan, carbon tetrabromide, and the like.

Furthermore, in the case where the polymerized toner particles used in the present invention contain a fixing property improver, natural wax such as carnauba wax, and olefinic wax such as polypropylene and polyethylene, and the like can be used as the fixing property improver.

In addition, in the case where the polymerized toner particles used in the present invention contain a charge-controlling agent, there is no particular limitation on the charge-controlling agent to be used, and a nigrosine dye, a quaternary ammonium salt, an organometallic complex, a metal-containing monoazo dye, and the like can be used.

Furthermore, example of the external additives used for improving fluidity and the like of the polymerized toner particles include silica, titanium oxide, barium titanate, fluororesin fine particles, acrylic resin fine particles, and the like, and they may be used alone or in combination.

In addition, examples of the salting-out agent used for separating polymerized particles from an aqueous medium, include metal salts such as magnesium sulfate, aluminum sulfate, barium chloride, magnesium chloride, calcium chloride, and sodium chloride.

The toner particles produced as described above has a volume average particle diameter in a range of from 2 to 15 μm, and preferably from 3 to 10 μm, and the polymerized toner particles have higher particle uniformity than the pulverized toner particles. In the case where the toner particles are smaller than 2 μm, the charging ability is lowered, and fogging and toner scattering are easy to occur, and in the case of larger than 15 μm, deterioration of image quality is caused.

An electrophotographic developer can be obtained by mixing the ferrite carrier and toner produced as described above. The mixing ratio of the ferrite carrier and the toner, that is, the toner concentration is preferably set to 3 to 15% by weight. In the case of less than 3% by weight, it is difficult to obtain desired image density, and in the case of more than 15% by weight, toner scattering and fogging are easy to occur.

The electrophotographic developer according to the present invention can also be used as a replenishment developer. In this case, the weight ratio of the toner in the developer, that is, the toner concentration is preferably set to 75 to 99.9% by weight.

The electrophotographic developer according to the present invention prepared as described above can be used in a copying machine, a printer, a FAX machine, a printing machine, and the like, which use a digital system employing a development system in which an electrostatic latent image formed on a latent image holder having an organic photoconductor layer or an inorganic photoconductive layer such as amorphous silicon is reversely developed with a magnetic brush of a two-component developer containing a toner and a ferrite carrier while applying a bias electric field. Further, the present invention can also be applied to a full-color machine or the like using an alternating electric field which is a method of superimposing an AC bias on a DC bias when a developing bias is applied from the magnetic brush to the electrostatic latent image side.

Hereinafter, the present invention will be described in detail based on Examples.

EXAMPLES

Example 1

Raw materials were weighed to be 50.5 mol of $Fe_2O_3$, 37.5 mol of $MnO_2$, 12.5 mol of $MgCO_3$, and 0.25 mol of $SrCO_3$ and pelletized by a roller compactor. The obtained pellets were calcined in a rotary firing furnace at 970° C. over 2 hours under atmospheric conditions.

The pellets was roughly pulverized by a dry bead mill, then added with water and pulverized by a wet bead mill over 6 hours, and PVA as a binder component was added thereto so as to be 3.2% by weight with respect to a slurry solid content, and a polycarboxylic acid dispersant was added thereto to have a viscosity of 3.0 poise, to thereby prepare a slurry. In this case, the solid content of the slurry was 50% by weight, and a particle diameter in which volume-based cumulative particle size distribution of powder contained in the slurry was 50% was 1.54 μm.

Subsequently, the obtained pulverized slurry was granulated and dried by being sprayed with a spray dryer at a discharge amount of 35 Hz, a rotation speed of 15,000 rpm and a drying temperature of 350° C., to obtain a granulated product. Next, the obtained granulated substance was classified to obtain a granulated substance 1 by adjusting the particle size so as to obtain a desired particle size distribution. The classification was performed by removing coarse particles having a particle diameter of more than 67 μm by passing a granulated substance through a mesh having an opening of 67 μm, and then removing the fine particles by an air classifier. The airflow classifier was set so as to have a content of particles having a particle diameter of 17 μm or less being 0.7% by weight.

Next, a particle diameter D50 in which the volume-based cumulative particle size distribution was 50%, of the granulated substance 1 from which coarse particles and fine particles had been removed by classification was measured by a laser diffraction particle size distribution measurement device (LA-950, Horiba, Ltd.). The number frequency of particles having a circularity of 0.80 or less of the granulated substance 1 was measured by the particle size shape distribution measuring apparatus described above.

Next, the classified granulated substance 1 was subjected to a primary firing at 700° C. in the air by using a rotary electric furnace under atmospheric conditions and then, subjected to a main firing to hold at a temperature of 1,180° C. for 4 hours under conditions of a mixed gas atmosphere of oxygen and nitrogen gases (oxygen gas concentration: 1.0% by volume) by using a tunnel type electric furnace, to thereby obtain a fired product. The obtained fired product was crushed and classified to obtain ferrite particles. The classification was performed by removing coarse particles having a particle size of more than 45 μm by passing the fired product through a mesh having a grain size of 45 μm, and then removing the fine particles by an airflow classifier. The air classifier was set so as to have a volume average particle diameter of 27 μm.

The obtained ferrite particles were subjected to a surface oxidation treatment by using a rotary electric furnace having a cooling portion following a hot portion, at 650° C. under atmospheric conditions at the hot portion, thereby obtaining surface oxidation-treated ferrite particles (carrier core material).

Example 2

This example was performed in the same manner as Example 1 except that the classification was performed by the airflow classifier so as to have a content of particles having a particle diameter of 17 μm or less being 1.5% by weight after passing through the mesh having an opening of 67 μm during the classification of the granulated substance, whereby surface oxidation-treated ferrite particles (carrier core material) were obtained.

Example 3

This example was performed in the same manner as Example 1 except that a slurry having a viscosity of 1.5 poise and a solid content of 40% was prepared and classification was performed by the airflow classifier so as to have a content of particles having a particle diameter of 17 μm or less being 1.0% by weight after passing through the mesh having an opening of 67 μm during the classification of the granulated substance, whereby surface oxidation-treated ferrite particles (carrier core material) were obtained.

Example 4

This example was performed in the same manner as Example 1 except that a slurry having a viscosity of 1.5 poise and a solid content of 40% was prepared and classification was performed by the airflow classifier so as to have a content of particles having a particle diameter of 17 μm or less being 1.5% by weight after passing through the mesh having an opening of 67 μm during the classification of the granulated substance, whereby surface oxidation-treated ferrite particles (carrier core material) were obtained.

Example 5

This example was performed in the same manner as Example 1 except that a temperature during the main firing was 1,172° C., whereby surface oxidation-treated ferrite particles (carrier core material) were obtained.

Example 6

This example was performed in the same manner as Example 1 except that a temperature during the main firing was 1,189° C., whereby surface oxidation-treated ferrite particles (carrier core material) were obtained.

Example 7

This example was performed in the same manner as Example 1 except that a temperature was 1,185° C. and an oxygen gas concentration was 2.5% by volume during the main firing, whereby surface oxidation-treated ferrite particles (carrier core material) were obtained.

Example 8

This example was performed in the same manner as Example 1 except that a temperature was 1,185° C. and an oxygen gas concentration was 2.5% by volume during the main firing, and a surface oxidation treatment was not performed, whereby ferrite particles (carrier core material) not subjected to a surface oxidation treatment were obtained.

Example 9

This example was performed in the same manner as Example 1 except that classification was performed by the airflow classifier by setting so as to have a volume average particle diameter of 35 μm after passing through a mesh having an opening of 50 μm during the classification of the fired product, whereby surface oxidation-treated ferrite particles (carrier core material) were obtained.

Example 10

This example was performed in the same manner as Example 1 except that classification was performed by the airflow classifier by setting so as to have a volume average particle diameter of 25 μm after passing through a mesh having an opening of 45 μm during the classification of the fired product, whereby surface oxidation-treated ferrite particles (carrier core material) were obtained.

Comparative Example 1

This comparative example was performed in the same manner as Example 1 except that classification was performed by the airflow classifier so as to have a content of particles having a particle diameter of 17 μm or less being 1.9% by weight after passing through the mesh having an opening of 67 μm during the classification of the granulated substance, whereby surface oxidation-treated ferrite particles (carrier core material) were obtained.

Comparative Example 2

This comparative example was performed in the same manner as Example 1 except that a slurry having a viscosity of 1.3 poise and a solid content of 35% was prepared and classification was performed by the airflow classifier so as to have a content of particles having a particle diameter of 17 μm or less being 1.2% by weight after passing through the mesh having an opening of 67 μm during the classification of the granulated substance, whereby surface oxidation-treated ferrite particles (carrier core material) were obtained.

Comparative Example 3

This comparative example was performed in the same manner as Example 1 except that a slurry having a viscosity of 1.3 poise and a solid content of 35% was prepared and classification was performed by the airflow classifier so as to have a content of particles having a particle diameter of 17 μm or less being 2.0% by weight after passing through the mesh having an opening of 67 μm during the classification of the granulated substance, whereby a carrier core material which was surface oxidation-treated ferrite particles was obtained.

Physical properties of the granulated substances 1, main firing conditions (firing temperature and oxygen gas concentration), surface oxidation treatment temperatures, the contents of Fe, Mn, Mg, and Sr in the ferrite particles (carrier core material), and physical properties of the carrier core material (fired product) in Examples 1 to 10 and Comparative Examples 1 to 3 are shown in Table 1. As the physical properties of the granulated substance 1, the content of particles having a particle diameter of 17 μm or less (−17 μm (%)), the average particle diameter (D50 (μm)) and the number frequency of particles having a circularity of 0.80 or less are shown.

described above, and frequency of 20 μm or less and frequency of 16 μm or less in the volume particle size distribution, and frequency of 16 μm or less in the number particle size distribution are shown.

TABLE 1

| | Characteristics of granulated substance 1 | | | Main firing | | Surface oxidation treatment | Chemical analytical value (ICP) | | | |
|---|---|---|---|---|---|---|---|---|---|---|
| | −17 μm (wt %) | D50 (μm) | Circularity 0.80 or less (%) | Firing temperature (° C.) | Oxygen gas concentration (%) | Surface oxidation treatment temperature (° C.) | Fe (wt %) | Mn (wt %) | Mg (wt %) | Sr (wt %) |
| Ex. 1 | 0.7 | 34.3 | 7.0 | 1,180 | 1.0 | 650 | 48.1 | 17.3 | 2.6 | 0.2 |
| Ex. 2 | 1.5 | 32.7 | 8.2 | 1,180 | 1.0 | 650 | 48.1 | 17.2 | 2.5 | 0.2 |
| Ex. 3 | 1.0 | 34.0 | 11.8 | 1,180 | 1.0 | 650 | 48.3 | 17.0 | 2.5 | 0.2 |
| Ex. 4 | 1.5 | 32.5 | 11.9 | 1,180 | 1.0 | 650 | 48.2 | 17.1 | 2.6 | 0.2 |
| Ex. 5 | 0.7 | 34.3 | 7.0 | 1,172 | 1.0 | 650 | 47.8 | 17.2 | 2.5 | 0.2 |
| Ex. 6 | 0.7 | 34.3 | 7.0 | 1,189 | 1.0 | 650 | 48.1 | 17.1 | 2.5 | 0.2 |
| Ex. 7 | 0.7 | 34.3 | 7.0 | 1,185 | 2.5 | 650 | 48.3 | 17.3 | 2.5 | 0.2 |
| Ex. 8 | 0.7 | 34.3 | 7.0 | 1,185 | 2.5 | None | 47.9 | 17.5 | 2.6 | 0.2 |
| Ex. 9 | 0.7 | 34.3 | 7.0 | 1,180 | 1.0 | 650 | 48.1 | 17.1 | 2.5 | 0.2 |
| Ex. 10 | 0.7 | 34.3 | 7.0 | 1,180 | 1.0 | 650 | 48.2 | 17.2 | 2.6 | 0.2 |
| Comp. Ex. 1 | 1.9 | 32.7 | 7.6 | 1,180 | 1.0 | 650 | 48.4 | 17.0 | 2.4 | 0.2 |
| Comp. Ex. 2 | 1.2 | 33.0 | 12.4 | 1,180 | 1.0 | 650 | 48.1 | 17.2 | 2.5 | 0.2 |
| Comp. Ex. 3 | 2.0 | 32.0 | 12.6 | 1,180 | 1.0 | 650 | 48.2 | 17.1 | 2.5 | 0.2 |

| | Physical properties of carrier core material | | | | | | | | | | |
|---|---|---|---|---|---|---|---|---|---|---|---|
| | BET specific surface area ($m^2/g$) | Saturation magnetization ($Am^2/kg$) | 1 mm, 500 V, Resistance R (Ω) | Apparent density D ($g/cm^2$) | Log Resistance R × Apparent density D | Volume average particle diameter (μm) | Volume particle size distribution −20 μm or less (%) | Volume particle size distribution −16 μm or less (%) | Number particle size distribution −16 μm or less (%) | Mesh-passing amount (wt %) | Particle strength index (wt %) |
| Ex. 1 | 0.180 | 56.7 | 1.5E+07 | 2.11 | 15.1 | 27.2 | 5.4 | 0.0 | 0.0 | 1.7 | 1.0 |
| Ex. 2 | 0.186 | 57.1 | 1.0E+07 | 2.09 | 14.6 | 27.0 | 5.1 | 0.0 | 0.0 | 2.9 | 1.2 |
| Ex. 3 | 0.183 | 56.1 | 1.2E+07 | 2.06 | 14.6 | 27.3 | 5.2 | 0.0 | 0.0 | 1.9 | 1.9 |
| Ex. 4 | 0.187 | 56.5 | 1.5E+07 | 2.05 | 14.7 | 27.1 | 5.3 | 0.0 | 0.0 | 2.8 | 2.0 |
| Ex. 5 | 0.207 | 57.2 | 1.5E+07 | 2.07 | 14.9 | 26.8 | 5.7 | 0.0 | 0.0 | 2.0 | 1.3 |
| Ex. 6 | 0.165 | 56.4 | 1.5E+07 | 2.13 | 15.3 | 27.3 | 5.3 | 0.0 | 0.0 | 2.3 | 0.8 |
| Ex. 7 | 0.164 | 50.6 | 1.3E+08 | 2.10 | 17.0 | 27.4 | 4.9 | 0.0 | 0.0 | 1.3 | 1.1 |
| Ex. 8 | 0.190 | 54.2 | 5.8E+05 | 2.10 | 12.1 | 27.3 | 5.2 | 0.0 | 0.0 | 1.0 | 1.3 |
| Ex. 9 | 0.150 | 56.8 | 9.6E+06 | 2.19 | 15.3 | 34.7 | 1.0 | 0.0 | 0.0 | 0.8 | 1.3 |
| Ex. 10 | 0.199 | 56.1 | 1.0E+07 | 2.03 | 14.2 | 24.2 | 6.8 | 0.0 | 0.0 | 2.4 | 1.4 |
| Comp. Ex. 1 | 0.177 | 55.6 | 9.0E+06 | 2.04 | 14.2 | 27.2 | 4.9 | 0.0 | 0.0 | 3.7 | 1.4 |
| Comp. Ex. 2 | 0.188 | 56.1 | 3.2E+07 | 2.05 | 15.4 | 28.5 | 4.3 | 0.0 | 0.0 | 1.9 | 2.7 |
| Comp. Ex. 3 | 0.182 | 55.9 | 3.0E+07 | 2.04 | 15.3 | 27.1 | 4.9 | 0.0 | 0.0 | 4.1 | 2.8 |

The contents of Fe, Mn, Mg, and Sr in the ferrite particles (carrier core material) were measured by a method using the ICP analyzer (ICPS-1000IV, Shimadzu Corporation) described above.

As the physical properties of the carrier core material, powder characteristics (volume average particle diameter, volume particle size distribution, number particle size distribution, BET specific surface area), magnetic characteristics (saturation magnetization), electric resistance R at a space between electrodes of 1.0 mm and an applied voltage of 500 V, apparent density D, a product of Log of the electric resistance R and the apparent density D (Log R×D), a mesh-passing amount, and a particle strength index are shown. The volume particle size distribution and the number particle size distribution of the carrier core material were determined by the microtrack particle size analyzer As shown in Table 1, any of the carrier core materials of Examples 1 to 10 had a mesh-passing amount of 3% by weight or less, and a particle strength index indicated by a difference between the mesh-passing amounts before and after a crushing treatment being 2% by weight or less. On the other hand, the carrier core materials of Comparative Examples 1 to 3 had a volume average particle diameter comparable with that of the carrier core materials of Examples 1 to 10, but had a mesh-passing amount of more than 3% by weight or a particle strength index of more than 2% by weight.

Example 11

First, an acrylic resin solution (resin solid content: 10% by weight) in which acrylic resin (Dianal LR-269, Mitsubishi Rayon Co., Ltd.) and toluene were mixed and the carrier core material (surface oxidation-treated ferrite particles) of Example 1 were mixed by a universal stirrer, so that the resin solution is adhered to the surface of the carrier core material. The resin solution was mixed with the carrier core material so that the solid content of the resin was 1.5% by weight. Subsequently, the carrier core material to which the resin solution is adhered was stirred over 3 hours while being heated to a temperature of 145° C. by a heat exchange-type stirring and heating device, to volatilize volatile components contained in the resin solution were volatilized to dry, whereby a resin-covered carrier in which the surface of the carrier core material was covered with the resin was obtained.

Then, the obtained resin-covered carrier and toner were mixed by stirring over 30 minutes by using a Turbula mixer, to obtain 1 kg of a developer (toner concentration: 7.5% by weight).

Example 12

A resin-covered carrier and a developer containing the resin-covered carrier were obtained in the same manner as in Example 11, except that the carrier core material (surface oxidation-treated ferrite particles) of Example 2 was used instead of the carrier core material of Example 1.

Example 13

A resin-covered carrier and a developer were obtained in the same manner as in Example 11, except that the carrier core material (surface oxidation-treated ferrite particles) of Example 3 was used instead of the carrier core material of Example 1.

Example 14

A resin-covered carrier and a developer were obtained in the same manner as in Example 11, except that the carrier core material (surface oxidation-treated ferrite particles) of Example 4 was used instead of the carrier core material of Example 1.

Example 15

A resin-covered carrier and a developer were obtained in the same manner as in Example 11, except that the carrier core material (surface oxidation-treated ferrite particles) of Example 5 was used instead of the carrier core material of Example 1.

Example 16

A resin-covered carrier and a developer were obtained in the same manner as in Example 11, except that the carrier core material (surface oxidation-treated ferrite particles) of Example 6 was used instead of the carrier core material of Example 1.

Example 17

A resin-covered carrier and a developer were obtained in the same manner as in Example 11, except that the carrier core material (surface oxidation-treated ferrite particles) of Example 7 was used instead of the carrier core material of Example 1.

Example 18

A resin-covered carrier and a developer were obtained in the same manner as in Example 11, except that the carrier core material (ferrite particles not subjected to a surface oxidation treatment) of Example 8 was used instead of the carrier core material of Example 1.

Example 19

A resin-covered carrier and a developer were obtained in the same manner as in Example 11, except that the carrier core material (surface oxidation-treated ferrite particles) of Example 9 was used instead of the carrier core material of Example 1.

Example 20

A resin-covered carrier and a developer were obtained in the same manner as in Example 11, except that the carrier core material (surface oxidation-treated ferrite particles) of Example 10 was used instead of the carrier core material of Example 1.

Comparative Example 4

A resin-covered carrier and a developer were obtained in the same manner as in Example 11, except that the carrier core material (surface oxidation-treated ferrite particles) of Comparative Example 1 was used instead of the carrier core material of Example 1.

Comparative Example 5

A resin-covered carrier and a developer were obtained in the same manner as in Example 11, except that the carrier core material (surface oxidation-treated ferrite particles) of Comparative Example 2 was used instead of the carrier core material of Example 1.

Comparative Example 6

A resin-covered carrier and a developer were obtained in the same manner as in Example 11, except that the carrier core material (surface oxidation-treated ferrite particles) of Comparative Example 3 was used instead of the carrier core material of Example 1.

An amount of carrier scattering by the developers of Examples 11 to 20 and Comparative Examples 4 to 6 are shown in Table 2. As for the carrier scattering, durable printing development was performed under appropriate exposure conditions by using imagio MP C2500 manufactured by Ricoh Corporation, and the amount of carrier scattering at 1,000 (1 k) times and 20,000 (20 k) times was visually counted.

TABLE 2

| | Carrier scattering amount | |
|---|---|---|
| | 1k | 20k |
| Example 11 | 4 | 6 |
| Example 12 | 8 | 4 |
| Example 13 | 5 | 10 |
| Example 14 | 8 | 9 |
| Example 15 | 5 | 7 |
| Example 16 | 7 | 6 |
| Example 17 | 3 | 7 |
| Example 18 | 3 | 6 |
| Example 19 | 4 | 8 |
| Example 20 | 8 | 6 |
| Comparative Example 4 | 16 | 8 |

TABLE 2-continued

| | Carrier scattering amount | |
|---|---|---|
| | 1k | 20k |
| Comparative Example 5 | 4 | 22 |
| Comparative Example 6 | 21 | 28 |

As shown in Table 2, in the developers of Examples 11 to 20 using the carrier core materials of Examples 1 to 10, the amount of carrier scattering was 10 or less at either 1 k times or 20 k times, which means that carrier scattering hardly occurred. On the other hand, in the developer of Comparative Example 4 using the carrier core material of Comparative Example 1, the amount of carrier scattering at 20 k times was comparable with that in Examples 11 to 20, but the amount of carrier scattering at 1 k times was large. In addition, in the developer of Comparative Example 5 using the carrier core material of Comparative Example 2, the amount of carrier scattering at 1 k times was comparable with that in Examples 11 to 20, but the amount of carrier scattering at 20 k times increased. In addition, in the developer of Comparative Example 6 using the carrier core material of Comparative Example 3, the amount of carrier scattering was very large at both 1 k times and 20 k times.

The results of Table 2 are considered to be caused by the mesh-passing amount and the particle strength index of the carrier core material constituting the developer. That is, in the developers of Examples 11 to 20, the carrier core materials of Examples 1 to 10 had a mesh-passing amount of 3% by weight or less, and had a particle strength index indicated by a difference between the mesh-passing amounts before and after a crushing treatment being 2% by weight or less, so that carrier scattering could be prevented. On the other hand, in the developer of Comparative Example 4, although the particle strength index of the carrier core material of Comparative Example 1 was 2% by weight or less, the mesh-passing amount was more than 3% by weight, and therefore carrier scattering could not be prevented. In addition, in the developer of Comparative Example 5, although the mesh-passing amount of the carrier core material of Comparative Example 2 was 3% by weight or less, the particle strength index was more than 2% by weight, and therefore carrier scattering could not be prevented. In addition, in the developer of Comparative Example 6, the mesh-passing amount of the carrier core material of Comparative Example 3 was more than 3% by weight and the particle strength index was more than 2% by weight, and therefore carrier scattering could not be prevented.

From the above, it is clear that although the carrier core materials of Examples 1 to 10 have a volume average particle diameter of about 27 μm to about 34 μm and whole are composed of a group of particles having a small particle diameter, since the mesh-passing amount is 3% by weight or less and the particle strength index is 2% by weight or less, occurrence of carrier scattering and damage to a photoreceptor or a fixing roller due to the carrier scattering can be reduced when being used as an electrophotographic developer as in Examples 11 to 20. On the other hand, in the carrier core materials of Comparative Examples 1 to 3, it is clear that the volume average particle diameter was compatible with that of the carrier core materials of Examples 1 to 10, but since the mesh-passing amount was more than 3% by weight or the particle strength index was more than 2% by weight, the occurrence of carrier scattering cannot be prevented when being used as an electrophotographic developer as in Comparative Examples 4 to 6.

INDUSTRIAL APPLICABILITY

Since the ferrite carrier core material for an electrophotographic developer according to the present invention has a small content of fine particles and high particle strength even in the case where powder is composed of a group of particles having a small particle diameter, it is possible to reduce the occurrence of carrier scattering and damage to a photoreceptor or a fixing roller due to the carrier scattering when being used as an electrophotographic developer, and to continuously obtain a printed product having good thin line reproducibility. According to the production method of the present invention, the ferrite carrier core material and the ferrite carrier can be stably obtained with productivity.

Therefore, the present invention can be used widely in fields of particularly a full-color machine in which high image quality is required and a high-speed machine in which reliability and durability of image maintenance are required.

Although the present invention has been described in detail with reference to particular embodiments, it will be apparent to those skilled in the art that various changes and modifications can be made without departing from the spirit and scope of the present invention.

The present application is based on Japanese Patent Application (No. 2017-064931) filed on Mar. 29, 2017, contents of which are incorporated herein as reference.

The invention claimed is:

1. A ferrite carrier core material for an electrophotographic developer, the ferrite carrier core material comprising:

a mesh-passing amount of 3 wt % or less as indicated by a ratio of a weight of ferrite particles passing through a 16 μm-mesh to a weight of whole particles constituting a powder; and a particle strength index of 2% by weight or less as determined by a difference between the mesh passing amounts before and after a crushing treatment, wherein the crushing treatment comprises housing the carrier core material in a sample case of a sample mill as a pulverizer, thereby applying the crushing treatment, and wherein the ferrite carrier core material is produced by firing a granulated substance including particles having a particle diameter of 17 μm or less being 1.5% by weight or less, and having a number frequency of particles having a circularity represented by following formula of 0.80 or less being 12% or less:

circularity=(perimeter of circle having a same area as projected image of particle)/(perimeter of projected image of particle).

2. The ferrite carrier core material for an electrophotographic developer according to claim 1, having a relationship between a volume average particle diameter M1 (μm) and a BET specific surface area S ($m^2/g$) satisfying the following formulae:

$$-0.0039\times M1+0.270\leq S\leq -0.0039\times M1+0.315;\text{ and}$$

$$M1=24\text{ to }35\ (\mu m).$$

3. The ferrite carrier core material for an electrophotographic developer of claim 1, wherein the ferrite particles have an electric resistance (R) of $5.0\times10^5$ to $1.0\times10^9\Omega$ at a space between electrodes of 1.0 mm and an applied voltage of 500 V, and wherein the ferrite particles have an apparent density (D) of 2.00 to 2.35 g/cm$^3$, wherein R and D satisfy the following formula:

$$12 \leq \text{Log } R \times D \leq 17.$$

4. The ferrite carrier core material for an electrophotographic developer according to claim 1, having a magnetization of 50 to 65 Am$^2$/kg by VSM measurement when a magnetic field of 1K·1000/4πA/m is applied.

5. The ferrite carrier core material for an electrophotographic developer according to claim 1, represented by a composition formula:

$$(MO)x.(Fe_2O_3)y,$$

wherein M is at least one metal selected from the group consisting of Fe, Mg, Mn, Ca, Cu, Zn, Ni, Sr, Zr, and Si, and wherein x+y=100 mol %.

6. The ferrite carrier core material for an electrophotographic developer of claim 1, wherein the ferrite carrier core material comprises 15% to 22% by weight of Mn, 0.5% to 3% by weight of Mg, 45% to 55% by weight of Fe, and 0.1% to 3.0% by weight of Sr.

7. A ferrite carrier for an electrophotographic developer of claim 1, wherein a surface of the ferrite carrier core material is covered with a resin.

8. An electrophotographic developer comprising the ferrite carrier of claim 7 and a toner.

9. The electrophotographic developer of claim 8, wherein the electrophotographic developer is a replenishment developer.

10. A method of producing the ferrite carrier core material of claim 1, the method comprising:

(i) classifying the granulated substance to obtain a granulated substance 1 by removing coarse particles having a particle diameter of more than 67 μm by passing the granulated substance through a mesh having an opening of 67 μm, and then removing fine particles by an air classifier;

(ii) subjecting granulated substance 1 to a primary firing at 700° C. and a main firing at 1180° C. to obtain a fired product; and (iii) crushing and classifying the obtained fired product of (ii) by removing coarse particles having a particle size of more than 45 μm by passing the fired product through a mesh having an opening of 45 μm, and then removing the fine particles by an airflow classifier.

11. A method of producing the ferrite carrier core material of claim 1, the method comprising:

(i) classifying the granulated substance by removing coarse particles by a mesh filtration method and by removing fine particles by an airflow classifier;

(ii) subjecting the classified granulated substance to a primary firing at 600 to 800° C. and a main firing at 1,120 to 1,220° C. to obtain a fired product; and (iii) crushing and classifying the obtained fired product of (ii) by removing coarse particles by a mesh filtration method and by removing fine particles by an airflow classifier.

12. The ferrite carrier core material for an electrophotographic developer according to claim 1, wherein the mesh-passing amount is 2.5 wt % or less.

13. The ferrite carrier core material for an electrophotographic developer according to claim 1, wherein the mesh-passing amount is 1.5 wt % or less.

14. The ferrite carrier core material for an electrophotographic developer according to claim 1, wherein the ferrite carrier core material comprises 17% to 22% by weight of Mn, 0.5% to 2.5% by weight of Mg, 47% to 55% by weight of Fe, and 0.3% to 2.0% by weight of Sr.

15. The ferrite carrier core material for an electrophotographic developer according to claim 1, wherein the ferrite carrier core material comprises 18% to 21% by weight of Mn, 0.5% to 2% by weight of Mg, 48% to 55% by weight of Fe, and 0.5% to 1.0% by weight of Sr.

16. A ferrite carrier core material for an electrophotographic developer, the ferrite carrier core material comprising:

a granulated substance classified to have a particle diameter of 17 μm or less of 1.5% by weight or less, the classified granulated substance being subject to a heat treatment such that the ferrite carrier core material has:

a mesh-passing amount of 3 wt % or less as indicated by a ratio of a weight of ferrite particles passing through a 16 μm-mesh to a weight of whole particles constituting a powder; and a particle strength index of 2% by weight or less as determined by a difference between the mesh passing amounts before and after a crushing treatment, wherein the crushing treatment comprises housing the carrier core material in a sample case of a sample mill as a pulverizer, thereby applying the crushing treatment.

* * * * *